US007004797B2

(12) United States Patent
Harada et al.

(10) Patent No.: US 7,004,797 B2
(45) Date of Patent: Feb. 28, 2006

(54) FEMALE TERMINAL WITH RATTLE PREVENTION FEATURE

(75) Inventors: Tomonori Harada, Shizuoka (JP); Yoshinori Shigeta, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 35 days.

(21) Appl. No.: 10/700,510

(22) Filed: Nov. 5, 2003

(65) Prior Publication Data

US 2004/0110414 A1 Jun. 10, 2004

(30) Foreign Application Priority Data

Nov. 5, 2002 (JP) ..... P2002-321344

(51) Int. Cl.
*H01R 13/11* (2006.01)

(52) U.S. Cl. ..... 439/857; 439/852

(58) Field of Classification Search ..... 439/843, 439/851, 852, 857, 752.5, 621
See application file for complete search history.

(56) References Cited

U.S. PATENT DOCUMENTS 4,391,485 A * 7/1983 Urani ..... 439/687
4,560,231 A * 12/1985 Shirai ..... 439/843
4,836,802 A * 6/1989 Phillips ..... 439/622
4,950,183 A * 8/1990 Watanabe et al. ..... 439/843
5,049,485 A * 9/1991 Deaton ..... 430/605
5,624,273 A * 4/1997 Myer ..... 439/399

FOREIGN PATENT DOCUMENTS

| | | |
|---|---|---|
| JP | 6-72169 | 10/1994 |
| JP | 8-321343 | 12/1996 |
| JP | 9-82391 | 3/1997 |

* cited by examiner

*Primary Examiner*—Neil Abrams
(74) *Attorney, Agent, or Firm*—Finnegan, Henderson, Farabow, Garrett & Dunner, L.L.P.

(57) ABSTRACT

A female terminal including a connecting portion having a resilient strip portion for constituting a contact with a male terminal and connected to the male terminal, and a tubular portion for supporting the connecting portion continuous to the connecting portion or incorporating the resilient strip portion of the connecting portion and formed by bending one sheet of a formed conductive metal plate in which an edge portion of a portion of forming the tubular portion of the metal plate is disposed on one corner portion side of the tubular portion and a projection portion projected to a side opposed to the edge portion is formed at a face having the edge portion on a side of a corner portion opposed to a corner portion on a side at which the edge portion is disposed and at least a portion of the edge portion and the projection portion are respectively constituted to overlap the corresponding corner portions. The edge and projection portions are formed to fit closely at corners of a terminal cavity to prevent rattling of the terminal in the cavity.

3 Claims, 16 Drawing Sheets

FEMALE TERMINAL WITH RATTLE PREVENTION FEATURE

The present invention is based on Japanese Patent Application No. 2002-321344, the entire contents of which are incorporated herein by reference.

BACKGROUND OF THE INVENTION

1. Field of the Invention

The present invention relates to a female terminal inserted with a male terminal to electrically connect to the male terminal.

2. Related Art

A female terminal forms an electric connector of a female type by being contained in housings having various shapes and is provided with a connecting portion having a resilient strip portion forming a contact brought into contact with a male terminal when the male terminal is inserted. There are various modes in a resilient strip portion of a female terminal, for example, a pair of resilient strip portions in a strip-like shape which is supported in a shape of a cantilever by a tubular portion and in which respective faces thereof are opposed to each other and the faces are most proximate to each other at a front end portion thereof (for example, refer to JP-UM-A-6-72169, page 2, FIG. 1, FIG. 2), or a single or two resilient strip portions opposed to each other front end portions of which are folded back to an inner side (for example, refer to JP-A-8-321343 pages 2–3, FIG. 1, JP-A-9-82391, pages 4–5, FIG. 1, FIG. 4). Such a female terminal is provided with a tubular portion continuous to a side of one end portion of a resilient strip portion for supporting the resilient strip portion or incorporating the resilient strip portion other than the resilient strip portion. Further, there is provided an electric wire attaching portion attached with an electric wire continuous to the tubular portion, a protecting portion for covering a front end portion of the resilient strip portion to protect and the like as necessary.

Further, the female terminals are formed by bending one sheet of a formed conductive metal plate (for example, refer to JP-UM-A-6-72169, page 2, FIG. 1, FIG. 2, JP-A-8-321343, pages 2–3, FIG. 1, JP-A-9-82391, pages 4–5, FIG. 1, FIG. 4).

Meanwhile, when a female terminal is contained in a cavity of a housing, rattling of the female terminal in the cavity, that is, movement thereof for rotating around a rotational axis in a direction along a direction of inserting the female terminal into the cavity by bringing respective faces of a tubular portion of the female terminal into contact with wall faces partitioning the cavity. Further, depending on a shape or a size of a lance formed for locking a female terminal by one face of faces for partitioning a cavity, there is a case in which in the one face, rattling of the female terminal in the cavity is restricted only by a wall of the face extended in a projected shape bulged to the center of the face along two corner portion portions of the face partitioning the cavity.

Meanwhile, the corner portion of the tubular portion of the female terminal is constituted by a curved face by forming the tubular portion by bending one sheet of a formed conductive metal plate. Therefore, in the one face of the cavity, when rattling of the female terminal in the cavity is restricted only by the wall of the face extended in the projected shape bulged to the center along the two corner portion portions of the face partitioning the cavity, depending on a relationship between a width of the face of the wall on the side of the cavity extended in the projected shape and a diameter of the curved face of the corner portion of the tubular portion, the corner portion of the tubular portion of the female terminal is not brought into contact with the face of the wall extended in the projected shape of the cavity and therefore, there is a case in which movement of the female terminal in the cavity cannot be restricted and the female terminal is rattled in the cavity. When the female terminal is rattled in the cavity, when viewed from a cross-sectional face of the cavity, the female terminal is brought into a state of being inclined in the cavity to bring about a drawback such that a male terminal cannot be inserted thereinto or a state of locking the female terminal by the lance is released. Therefore, there is desired a female terminal which is difficult to rattle in a cavity regardless of a structure of a cavity such as a shape of a wall of a face partitioning the cavity.

SUMMARY OF THE INVENTION

The invention is aimed at making a female terminal strong against rattling in a cavity regardless of a structure of a cavity of a housing.

A female terminal of the invention resolves the above-described problem by constituting a female terminal comprising a connecting portion having a resilient strip portion constituting a contact with a male terminal and connected to the male terminal, and a tubular portion continuous to the connecting portion for supporting the connecting portion or incorporating the resilient strip portion of the connecting portion and formed by bending one sheet of a formed conductive metal plate wherein an edge portion of a portion of the metal plate for forming the tubular portion is disposed on a side of one corner portion of the tubular portion, a projection portion projected to a side opposed to the edge portion is formed on a side of a corner portion of a face having the edge portion on a side opposed to the one corner portion of a side at which the edge portion is disposed and at least a portion of the edge portion and the projection portion are respectively made to overlap the corner portions in correspondence therewith.

According to the constitution, even when rattling of the female terminal in the cavity is restricted only by the face of the wall extended in the projected shape bulged to the center of the face along the two corner portion portions of the face partitioning the cavity, the edge portion of the portion forming the tubular portion of the metal plate disposed on the side of the one corner portion and the projection portion provided on the side of the corner portion on the side opposed to the corner portion of the face having the edge portion on the side at which the edge portion is disposed are respectively brought into contact with the face of the wall of the cavity extended in the projected shape. Therefore, movement of the female terminal in the cavity is restricted and the female terminal is made to be difficult to rattle in the cavity. That is, regardless of the structure of the cavity of the housing, the female terminal can be made to be difficult to rattle in the cavity.

Further, when an electric connector having the above-described female terminal is constituted, the female terminal is difficult to rattle in the cavity and therefore, a drawback is difficult to be brought about in inserting the male terminal or the like and reliability of the electric connector can be promoted.

DETAILED DESCRIPTION OF THE PREFERRED EMBODIMENTS (First Embodiment)

Figure 1:
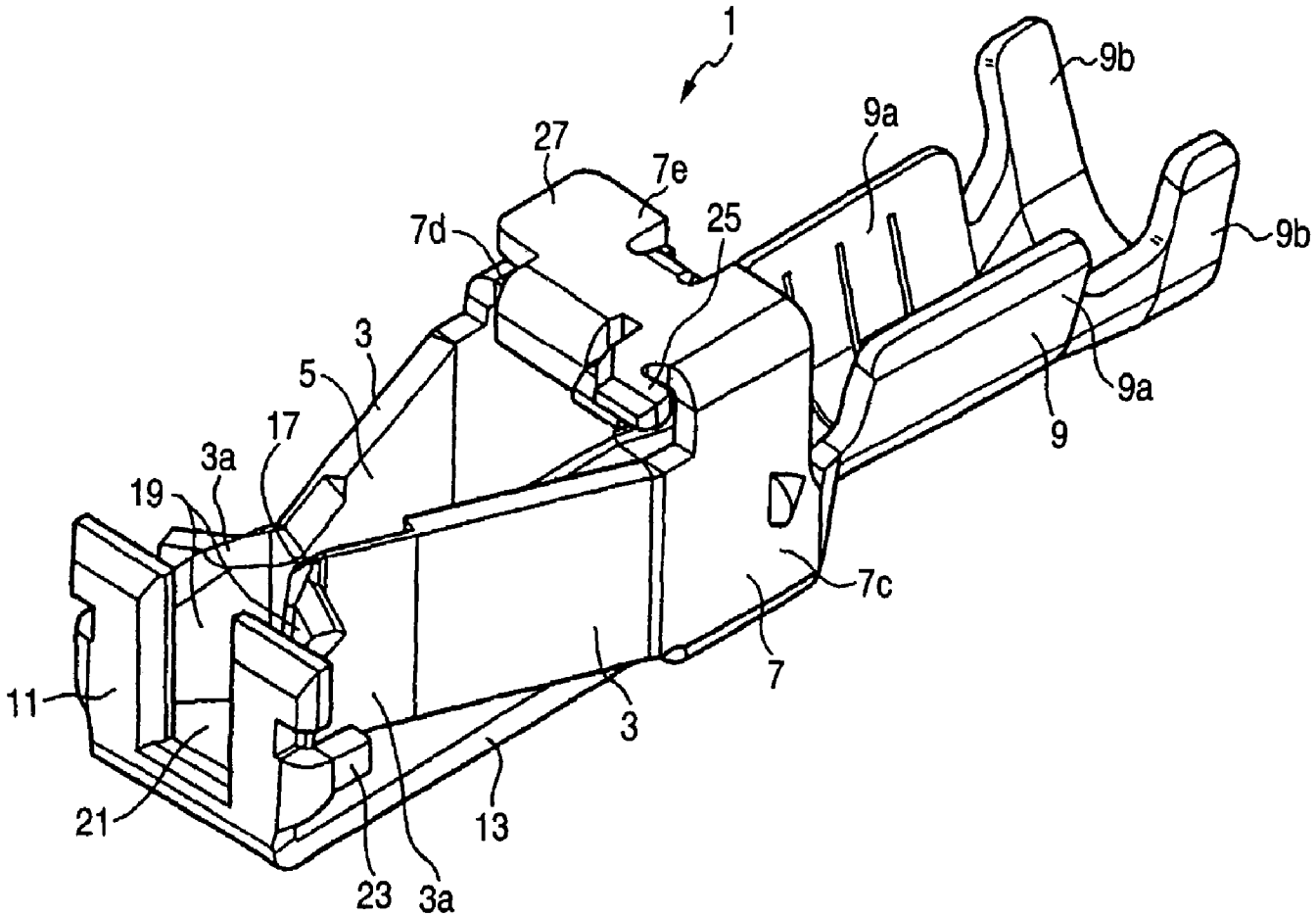
FIG. 1 is a perspective view showing an outline constitution of a first embodiment of a female terminal constituted by applying the invention.
Figure 2:
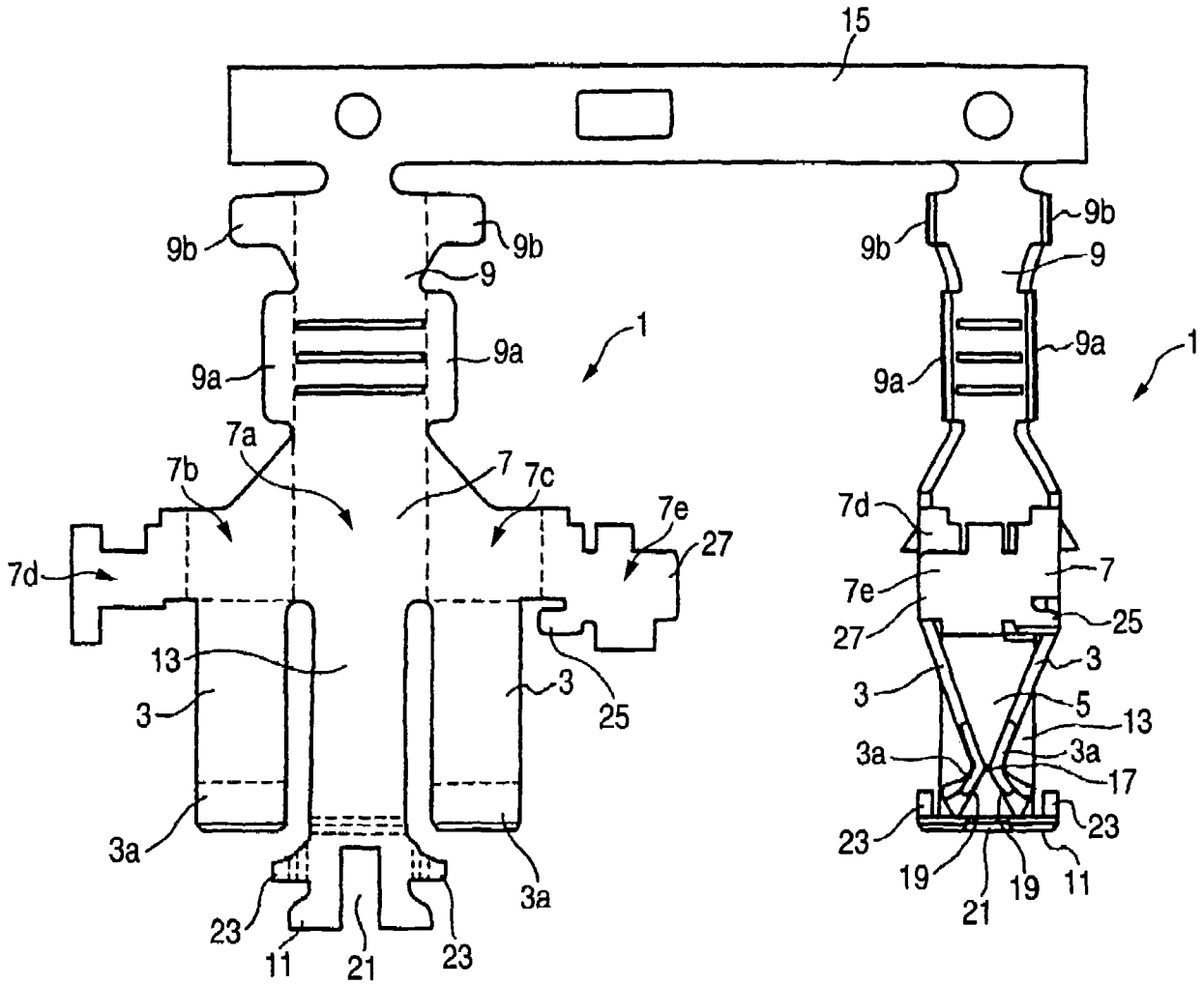
FIG. 2 is a plane view showing an outline constitution of the first embodiment of the female terminal constituted by applying the invention in a developed state and a finished state.
Figure 3:
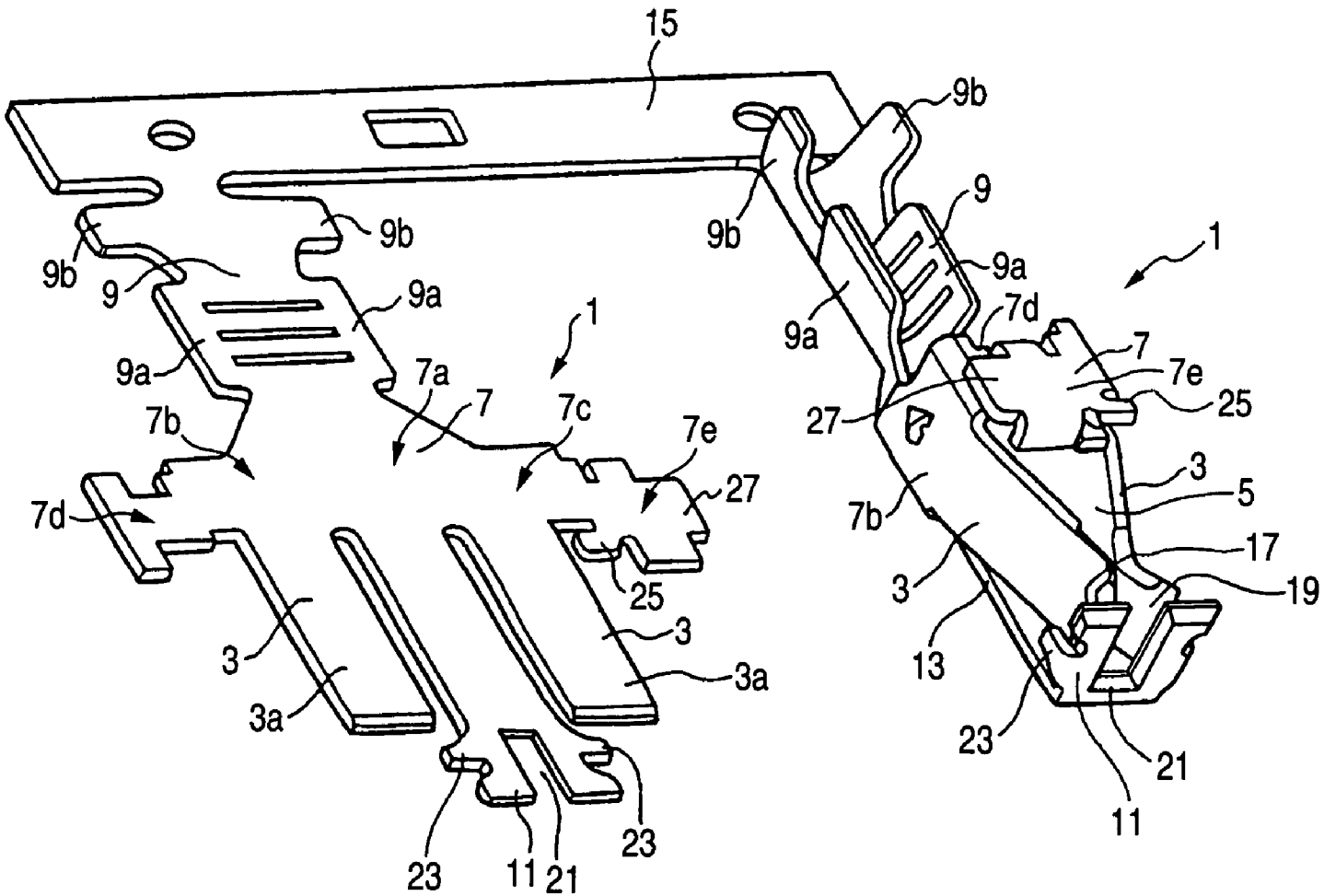
FIG. 3 is a perspective view showing the outline constitution of the first embodiment of the female terminal constituted by applying the invention by the developed state and the finished state.
Figure 4:
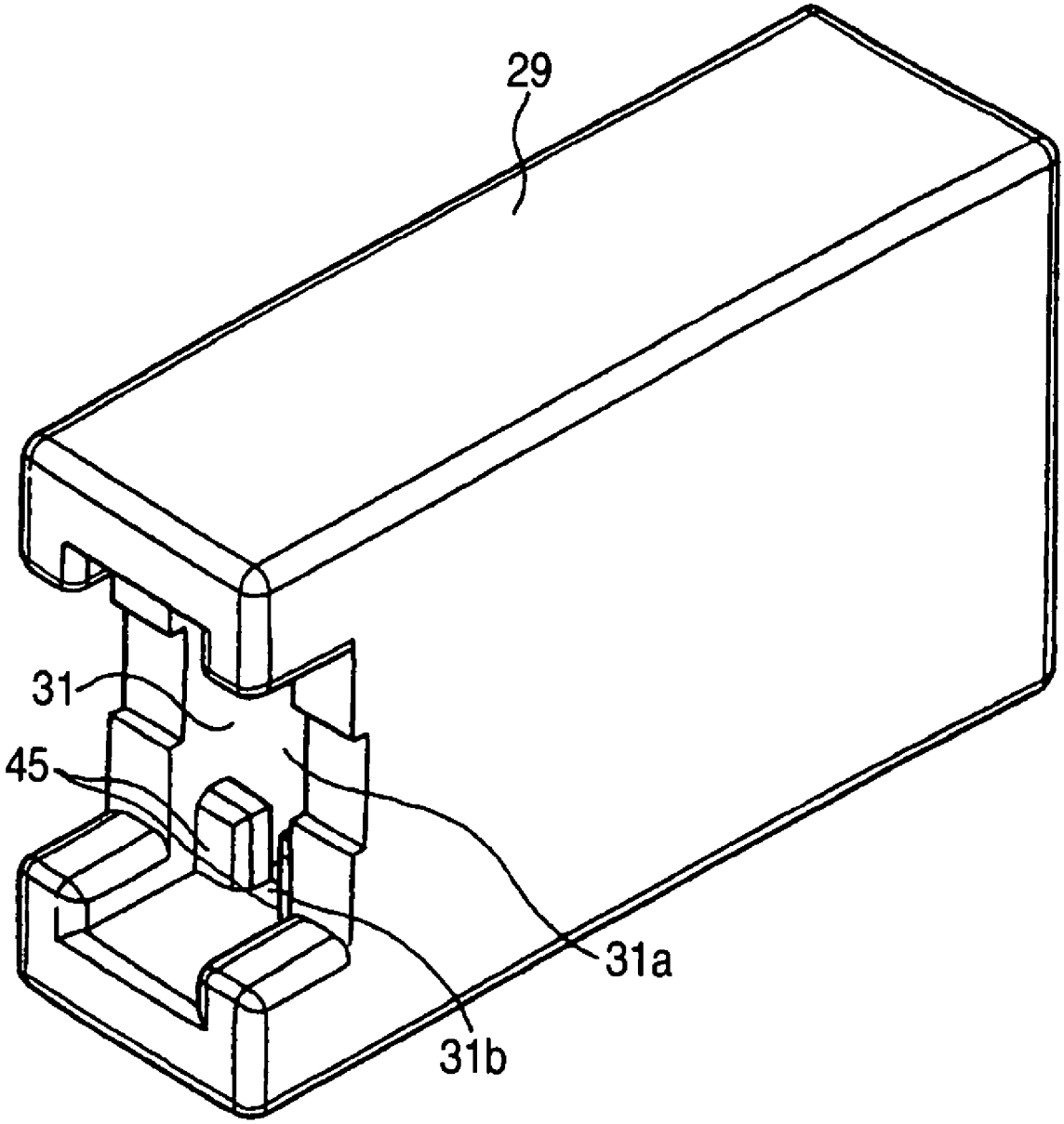
FIG. 4 is a perspective view showing an outline constitution of an example of a housing mounted with the female terminal constituted by applying the invention.
Figure 5:
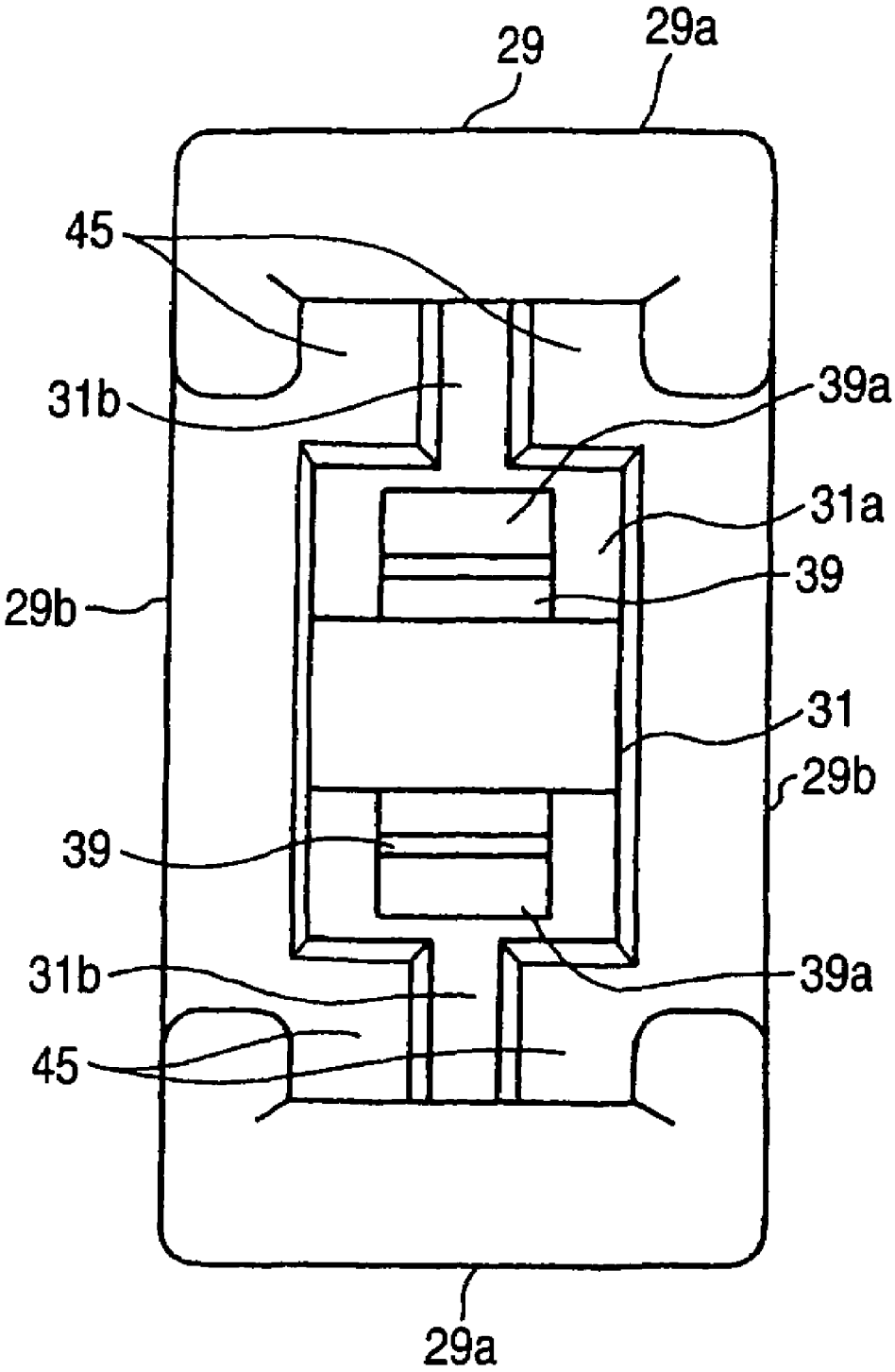
FIG. 5 is a view of an example of the housing mounted with the female terminal constituted by applying the invention viewed from a fuse inserting port.
Figure 6:
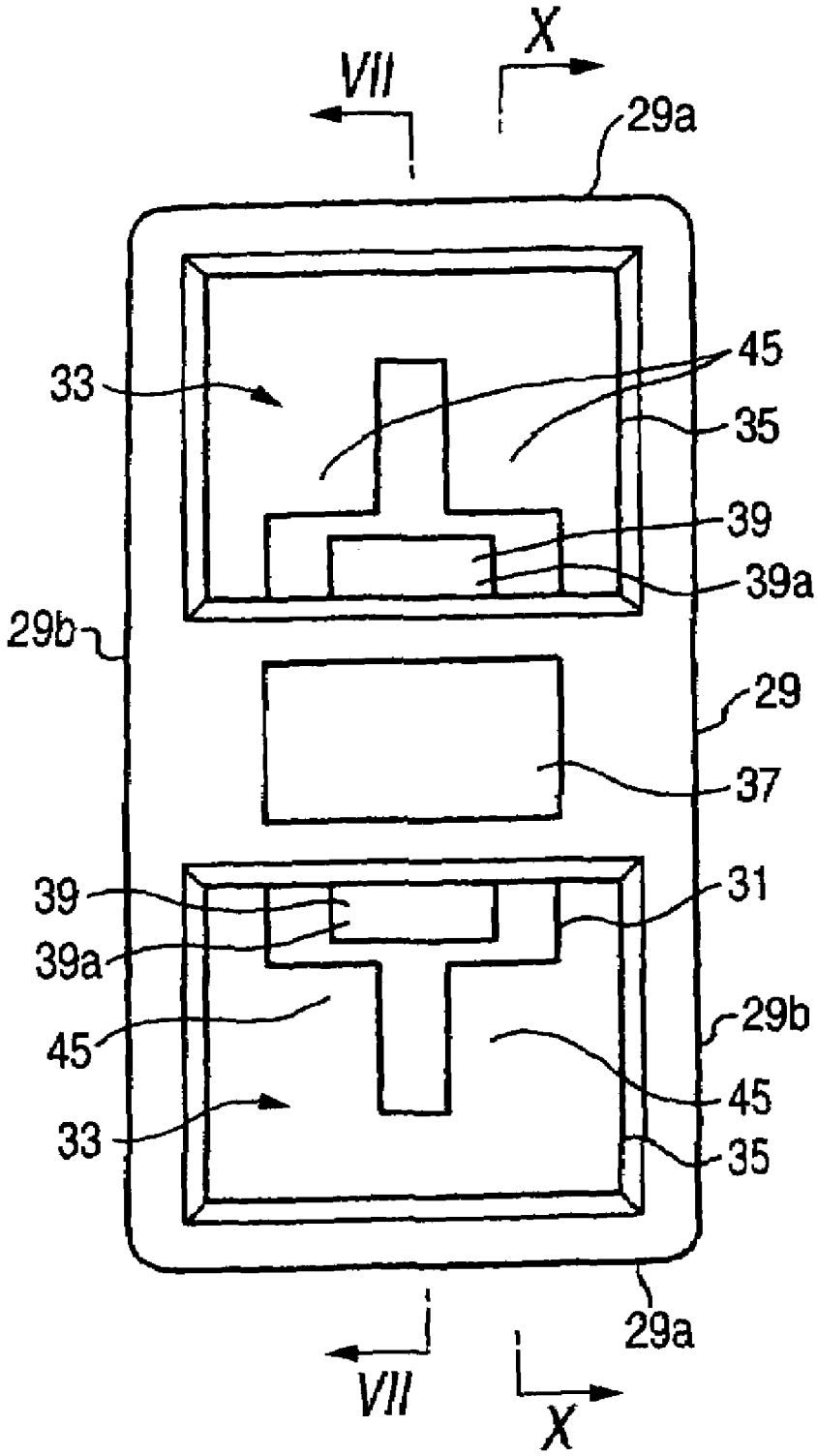
FIG. 6 is a view of the example of the housing mounted with the female terminal constituted by applying the invention from a side of a female terminal inserting port.
Figure 7:
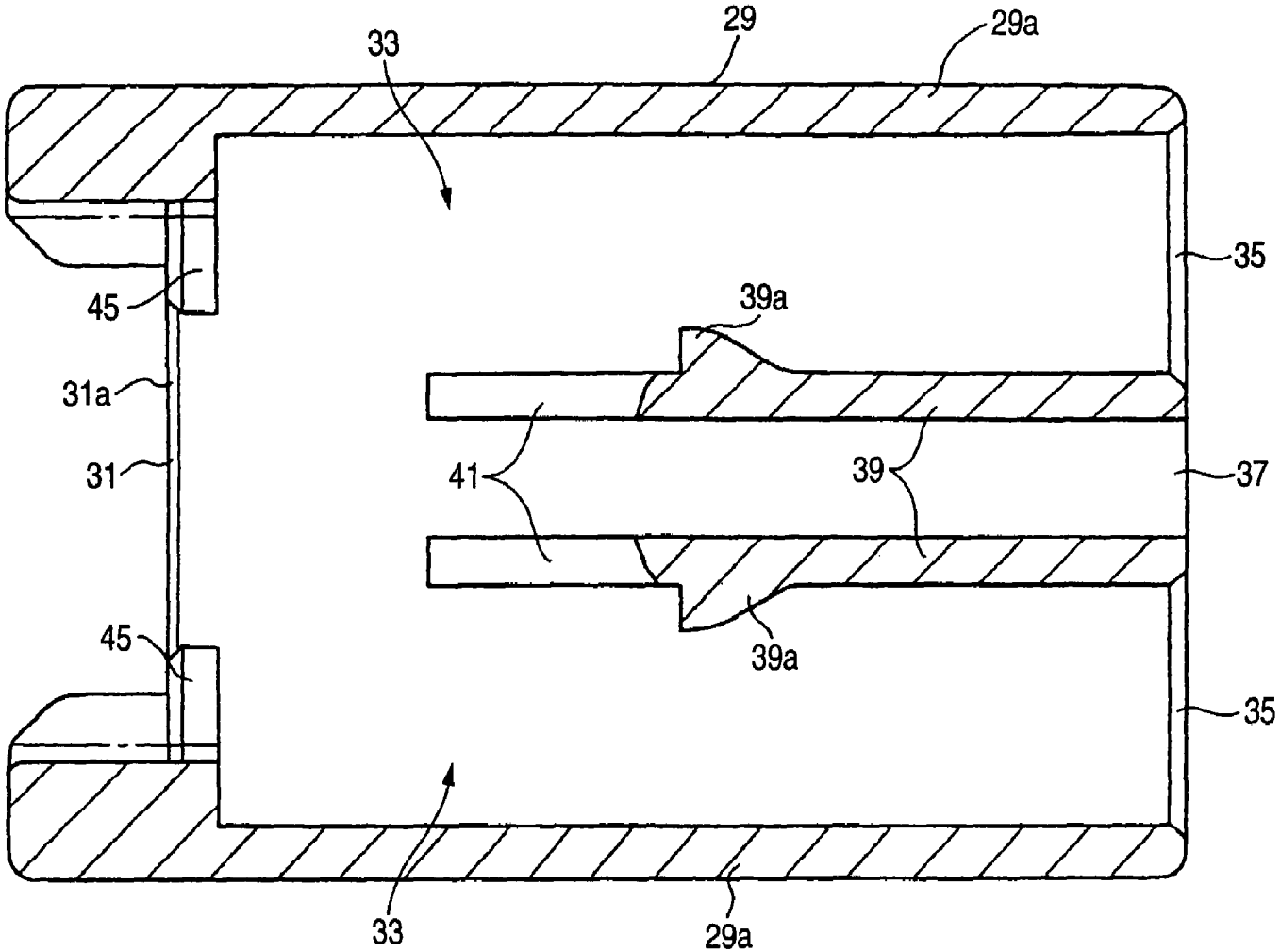
FIG. 7 is a sectional view of the housing mounted with the female terminal constituted by applying the invention from a line VII—VII of FIG. 6.
Figure 8:
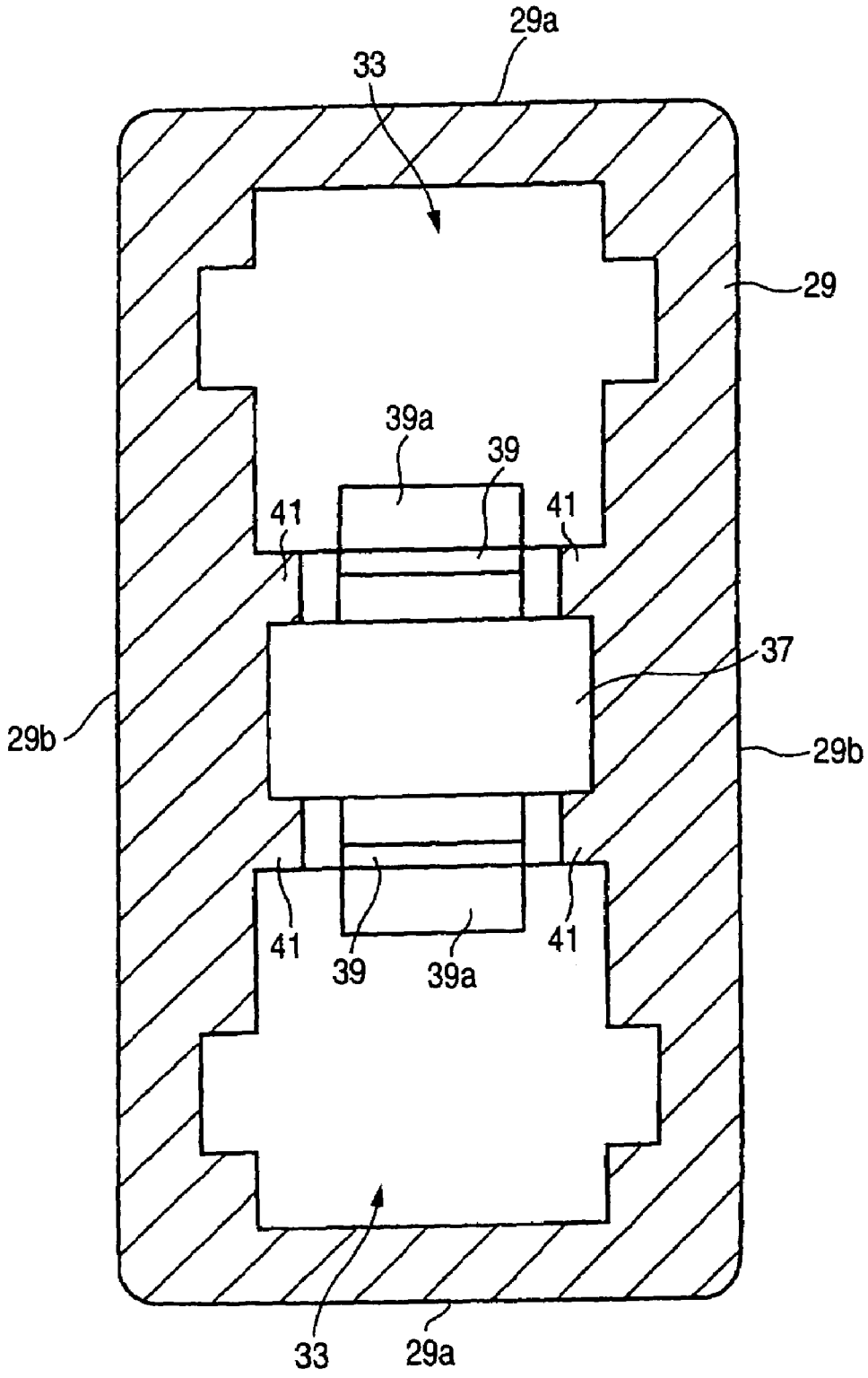
FIG. 8 is a cross-sectional view of the housing mounted with the female terminal constituted by applying the invention.

A first embodiment of a female terminal constituted by applying the invention will be explained in reference to FIG. 1 through FIG. 12 as follows. FIG. 1 is a perspective view showing an outline constitution of a female terminal constituted by applying the invention. FIG. 2 is a plane view showing an outline constitution of the female terminal constituted by applying the invention in a developed state and a finished state. FIG. 3 is a perspective view showing the outline constitution of the female terminal constituted by applying the invention in the developed state and the finished state. FIG. 4 is a perspective view of a housing mounted with the female terminal constituted by applying the invention. FIG. 5 is a view of the housing mounted with the female terminal constituted by applying the invention viewed from a side of a fuse inserting port. FIG. 6 is a view of the housing mounted with the female terminal constituted by applying the invention viewed from a side of a female terminal inserting port. FIG. 7 is a sectional view of the housing mounted with the female terminal constituted by applying the invention viewed from a line VII—VII of FIG. 6. FIG. 8 is a cross-sectional view of the housing mounted with the female terminal constituted by applying the invention.

Figure 9:
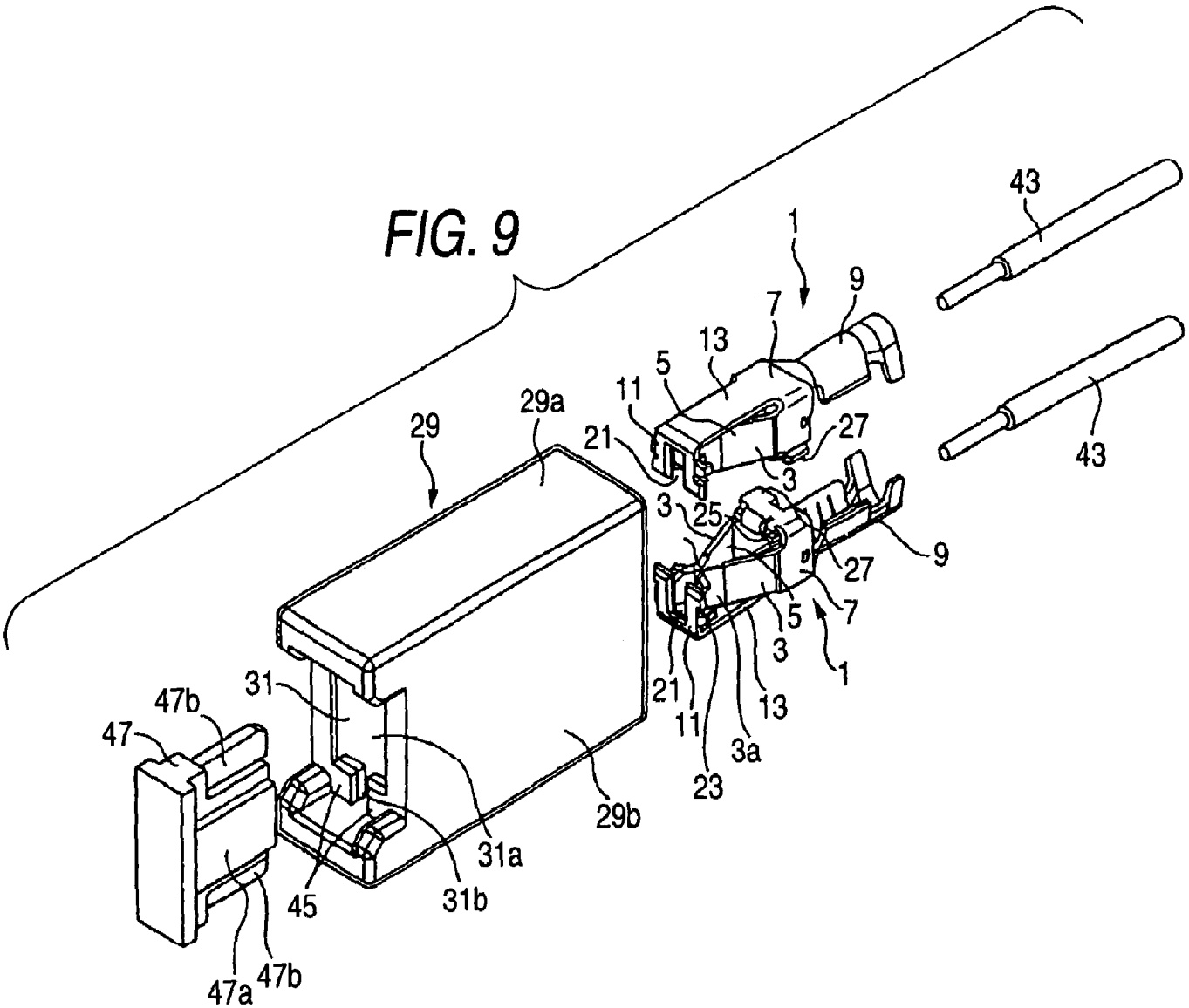
FIG. 9 is a perspective view showing a method of integrating a fuse box constituted by the female terminal and the housing constituted by applying the invention.
Figure 10:
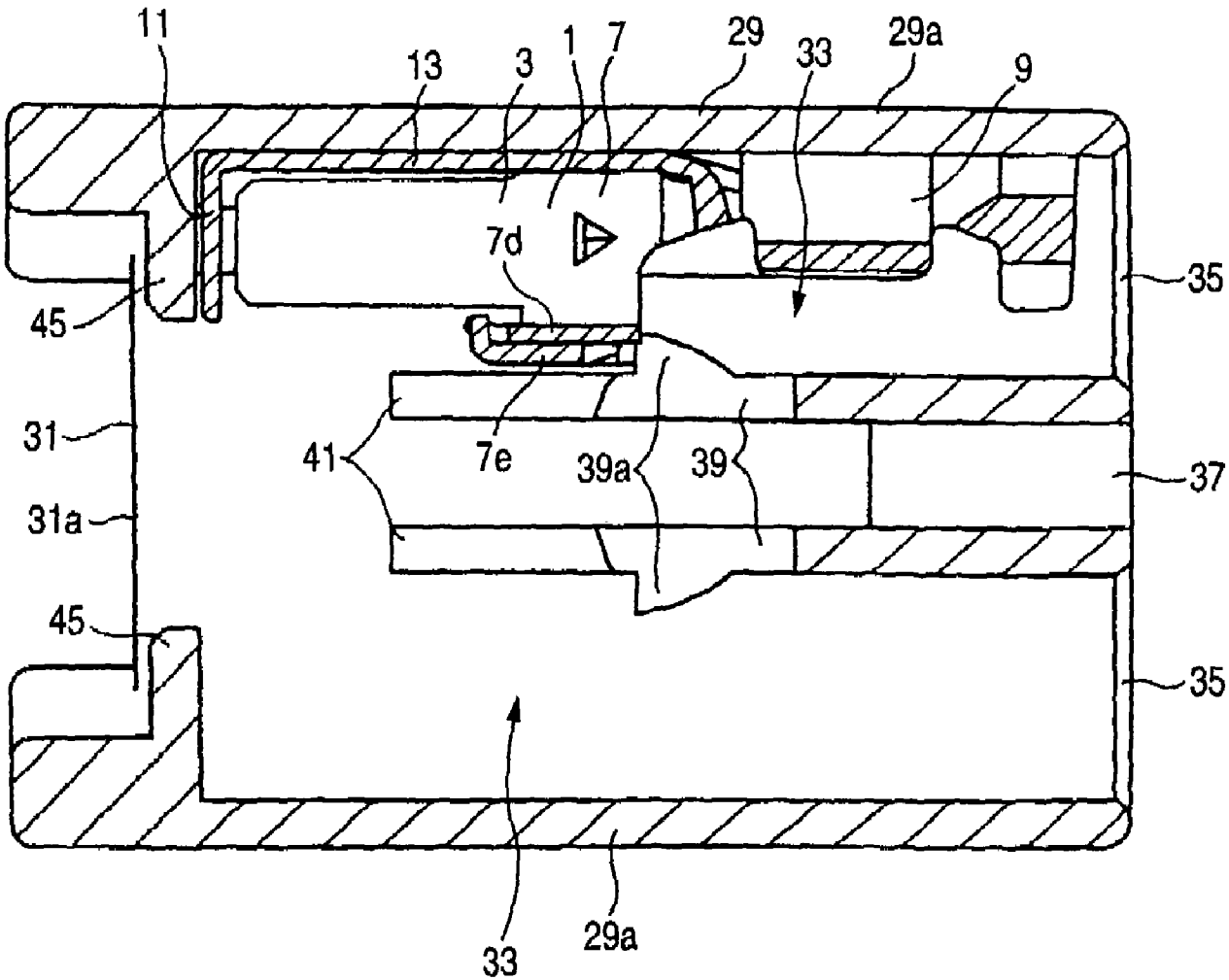
FIG. 10 is a sectional view showing a state of mounting the female terminal constituted by applying the invention to insert into the housing viewed from a line X—X of FIG. 6.
Figure 11:
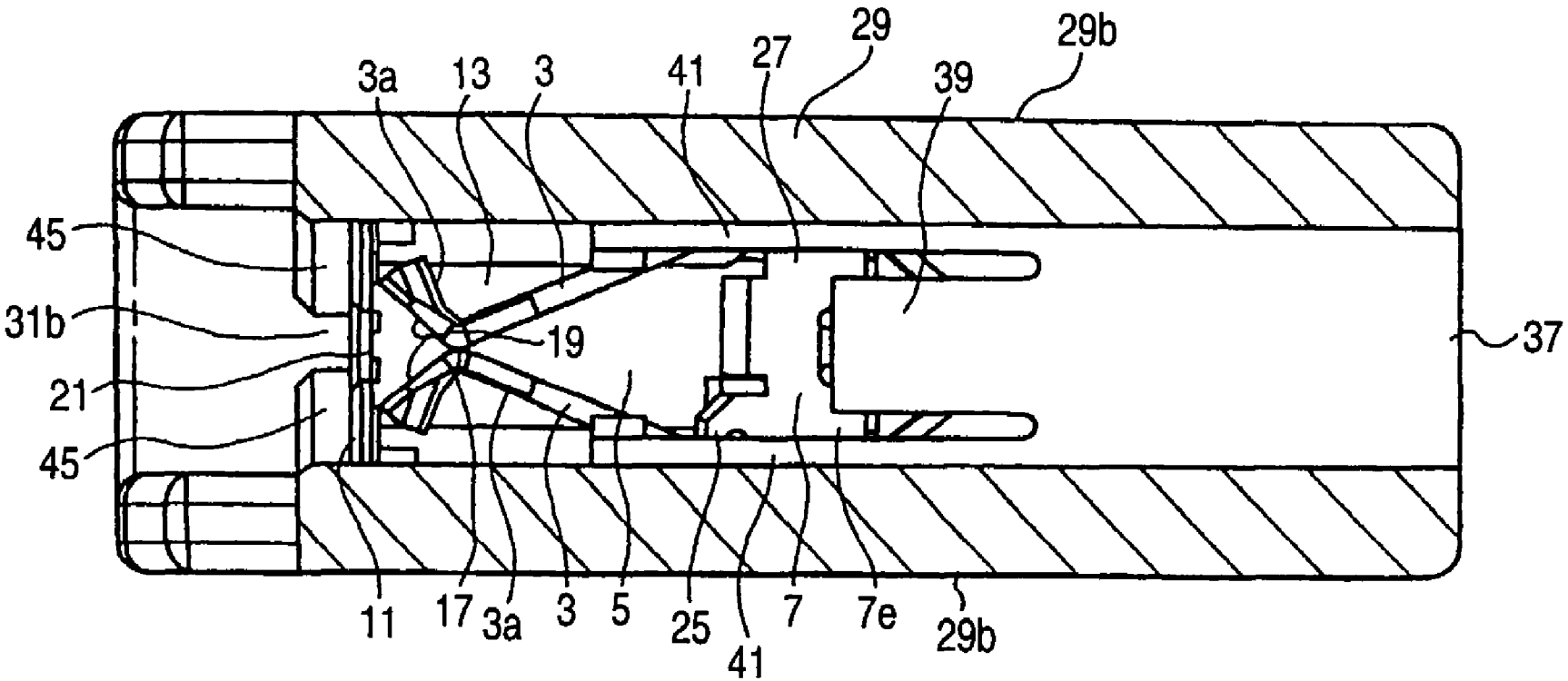
FIG. 11 is a sectional view showing a state of mounting the female terminal constituted by applying the invention to the housing viewed from a line X—X of FIG. 6.
Figure 12:
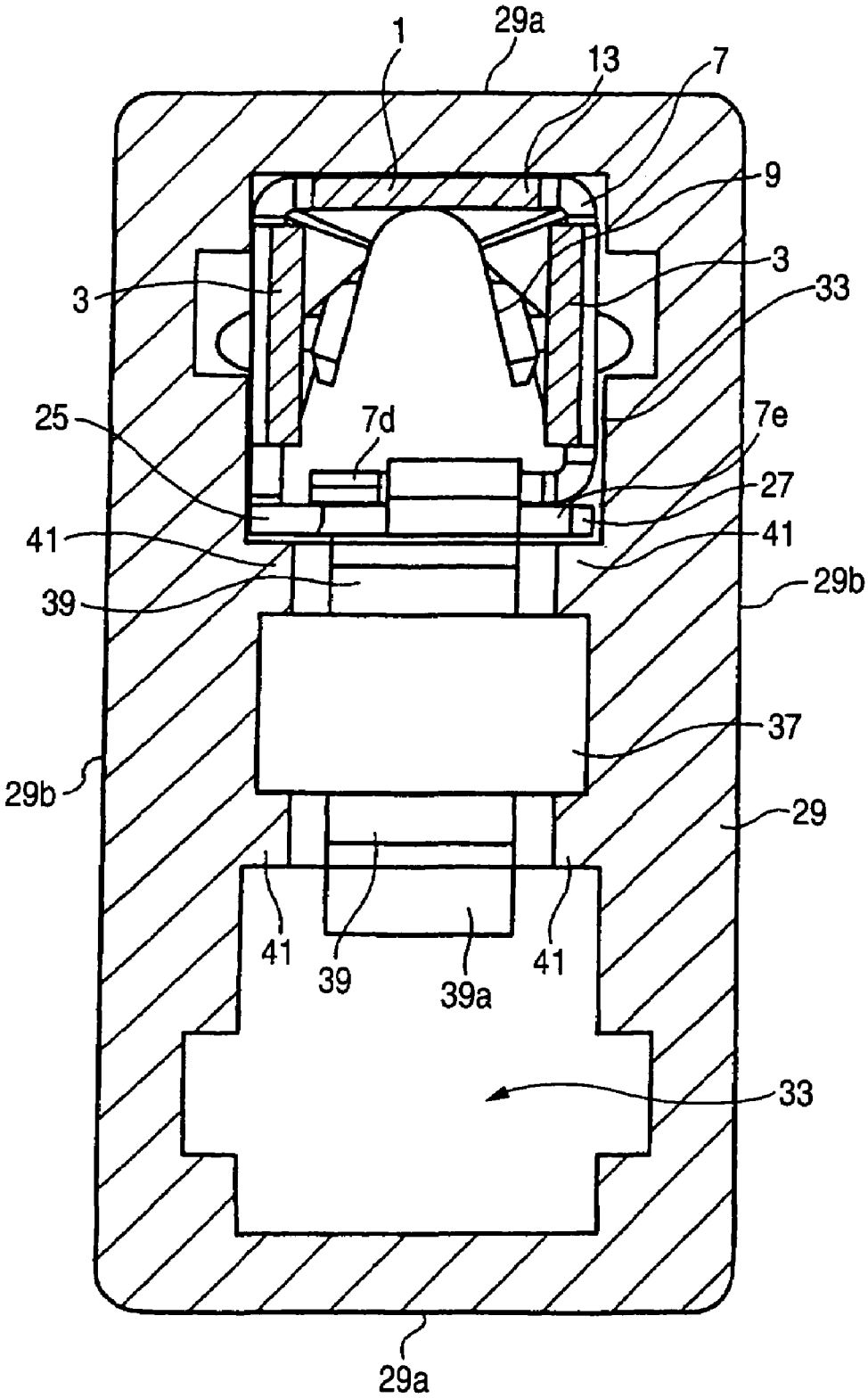
FIG. 12 is a cross-sectional view of the female terminal and the housing showing a state of mounting the female terminal constituted by applying the invention to the housing.

FIG. 9 is a perspective view showing a method of integrating a fuse box constituted by the female terminal and the housing constituted by applying the invention. FIG. 10 is a sectional view showing a state of mounting the female terminal constituted by applying the invention to insert into the housing viewed from a line X—X of FIG. 6. FIG. 11 is a sectional view showing a state of mounting the female terminal constituted by applying the invention to the housing viewed from the line X—X of FIG. 6. FIG. 12 is a cross-sectional view of the female terminal and the housing showing a state of mounting the female terminal constituted by applying the invention to the housing. Further, in FIG. 2 and FIG. 3, there are shown chained terminals in which a plurality of female terminals are connected to a generator, that is, a bus bar and in FIG. 1 and FIG. 8, there is shown a single female terminal, that is, a single pole terminal. In this way, the invention is applicable regardless of modes of the female terminal such as the chained terminals and the single pole terminal. Further, according to the embodiment, as an electric connector having a female terminal, an electric connector of a socket type for mounting an electric part having a male terminal is exemplified, specifically, a fuse box is exemplified as an electric connector having a fuse as an electric part and a female terminal is exemplified.

As shown by FIG. 1 through FIG. 3, a female terminal 1 of the embodiment includes a connecting portion 5 having a pair of resilient strip portions 3 and connected with a male tab of a fuse, a tubular portion 7 for supporting one end portion of the electric piece 3 in a shape of a cantilever, an electric wire attaching portion 9 continuous to the tubular portion 7 for attaching an electric wire, a protecting portion 11 for protecting a front end portion 3*a* of the resilient strip portion 3, and a connecting portion 13 for connecting the protected portion 11 to the tubular portion 9 and the like. Further, in FIG. 2 and FIG. 3, a plurality of the female terminals 1 are connected by a bus bar 15.

The resilient strip portions 3 are formed in a strip-like shape in which respective end portions thereof on one side are continuous to side walls opposed to each other of the tubular portion 7 formed in a shape of a square cylinder. Respective inner faces of the pair of resilient strip portions 3 continuous to the side walls of the tubular portion 7 opposed to each other are brought into a state of being opposed to each other. Further, the resilient strip portions 3 are successively narrowed in an interval of the pair of resilient strip portions 3 as proceeding to the front end portion 3*a* from the side of the tubular portion 7 and respectively folded to bend to outer sides at positions thereof at which the inner faces of the pair of resilient strip portions 3 are most proximate to each other. Thereby, a contact 17 brought into contact with a male tab of a fuse is formed at the front end portions 3*a* of the pair of resilient strip portions 3. Further, an interval from respective front ends of the pair of resilient strip portions 3 to the contact 17 are constituted by a taper shape in which the interval between the pair of resilient strip portions 3 is successively enlarged from the contact 17 to the respective front ends of the resilient strip portions 3 and inner faces in the taper shape from the contact 17 to the front ends of the resilient strip portions 3 constitute guide faces 19 for guiding the front end portion of the male tab of the fuse to the contact 17 by being brought into contact with the front end portion of the male tab of the fuse.

The electric wire attaching portion 9 is formed at one side wall other than the side walls continuous to the resilient strip portions 3 of the tubular portion 7 formed in the shape of the square cylinder continuously in a direction opposed to the resilient strip portion 3 and formed with two pairs of sandwiching pieces 9*a* and 9*b* for sandwiching the electric wire in a side direction of a portion thereof in a strip-like shape.

The protecting portion 11 is formed to be folded to bend substantially by an angle of 90 degrees relative to a direction of extending the connecting portion 13 at a front end of the connecting portion 13 formed continuously in a direction the same as that of the resilient strip portion 3 at a side wall the same as the side wall of the tubular portion 7 formed in a square tubular shape continuous to the electric attaching portion 9. Thereby, the protecting portion 11 is brought into the state of covering a side of the front end portions 3*a* of the resilient strip portions 3 inserted with the male tab of the fuse, that is, the side of the guide faces 19 to protect the front end portion 3*a* of the resilient strip portion 3. Further, the protective 11 is formed with an opening 21 in a slit-like shape capable of inserting the male tab of the fuse in a state of being cut from an edge portion of the protecting portion 11. Two side edges of the protecting portion 11 are provided with restricting projections 23 constituting restricting device a range of moving the resilient strip portion 3 for preventing deformation or setting of the resilient strip portion 3 by excessive deformation thereof by being projected in a direction of the tubular portion 7 by an angle of substantially 90 degrees relative to a face of the protecting portion 11 and restricting the range of moving the resilient strip portion 3 in an outer direction.

The connecting portion 13 is constituted by a strip-like shape and formed continuous to a side wall the same as the side wall continuous to the electric wire attaching portion 9 of the tubular portion 7 formed in the shape of the square cylinder as described above and extended in a direction the same as that of the resilient strip portion 3. Therefore, the connecting portion 13 is provided in a form overlapping the pair of resilient strip portions 3 from the tubular portion 7 to the front end portion 3*a* of the resilient strip portion 3.

As shown by FIG. 2 and FIG. 3, such a female terminal 1 is formed by bending one sheet of a conductive metal plate, for example, a copper plate or the like formed by, for example, being punched by a punching die. Further, a broken line in FIG. 2 designates a folding to bend line in bending.

In a state of developing the female terminal 1, at a portion 7*a* constituting one side wall of the tubular portion 7, the electric wire attaching portion 9 and the connecting portion 13 are continuous in a strip-like shape at both ends thereof. From portions 7*b* and 7*c* contiguous to the portion 7*a* for constituting the side wall of the tubular portion 7 continuous to the electric wire attaching portion 9 and the connecting portion 13 for constituting two side walls bent by 90 degrees relative to the portion 7*a* for constituting the side wall, the resilient strip portions 3 are extended in a state of being in parallel with the connecting portion 13 and in a direction the same as that of the connecting portion 13. In a developed state, the resilient strip portion 3 and the connecting portion 13 are extended in parallel with each other and formed by substantially the same length. Further, the protecting portion 11 is formed continuous to the connecting portion 13. The protecting portion 11 is provided with the restricting projection 23 in a state of being projected in a side direction of the protecting portion 11. A portion of the protecting portion 11 frontward from a position of providing the restricting projection 23 is temporarily brought into a state of being narrowed to a width to a degree the same as the width of the connecting portion 13 and thereafter enlarged more than the connecting portion 13.

The portion 7*b* for constituting the side wall for supporting the resilient strip portion 3 is provided with a portion 7*d* for constituting a side wall opposed to the portion 7*a* for constituting the side wall continuous to the electric wire attaching portion 9 and the connecting portion 13 by being bent by 90 degrees relative to the portion 7*b* for constituting the side wall. The portion 7*c* for constituting the side wall for supporting other one of the resilient strip portion 3 is provided with a portion 7*e* for constituting a side wall opposed to the portion 7*a* for constituting the side wall continuous to the electric wire attaching portion 9 and the connecting portion 13 by being bent by 90 degrees relative to the portion 7*c* for constituting the side wall to overlap the portion 7*d* for constituting the above-described side wall. A projection portion 25 in a tongue-like shape projected to the resilient strip portion 3 is formed at an edge of the portion 7*e* for constituting the one side wall of the tubular portion 7 on a side of a folded to bend portion of the portion 7*e* and the portion 7*c* for constituting the side wall continuous to the portion 7*e* and on an edge of extending the resilient strip portion 3.

The tubular portion 7 is formed in the cylindrical shape by bending the portions 7*a* through 7*e* of the tubular portion 7 for constituting the respective side walls formed in this way in the developed state. At this occasion, a corner portion of the cylindrical potion 7 is constituted by a curved face. As shown by FIG. 1 through FIG. 3, the side wall of the tubular portion 7 which does not support the resilient strip portion 3 or the connecting portion 13 is formed by overlapping the portion 7*e* for constituting the side wall on the portion 7*d* for constituting the side wall. In the side walls formed by the portions 7*d* and 7*e* for constituting the side walls, an edge portion 27 extended in a direction along a direction of extending the female terminal 1 of the portion 7*e* for constituting the side wall, is bulged in a side direction of the female terminal 1 on a side of a corner portion of the portion 7*b* for constituting the side wall and the portion 7*d* for constituting the side wall in a state of overlapping a curved face of the corner portion and reaches a position in correspondence with an outer face of the portion 7*b* for constituting the side wall.

The projection portion 25 is provided in a plane the same as that of the portion 7*e* for constituting the side wall formed with the projection portion 25 when the tubular portion 7 is formed by bending. Further, the projection portion 25 is disposed on a side of a corner portion opposed to a side of a corner portion of the portion 7*b* constituting the side wall and the portion 7*d* for constituting the side wall of the side wall formed by the portions 7*d* and 7*e* for constituting the side wall, that is, on a side of a corner portion of the portion 7*c* for constituting the side wall and the portion 7*e* for constituting the side wall. Further, the projection portion 25 is bulged in the side direction of the female terminal 1 in the state of overlapping the curved face of the corner portion of the portion 7*c* for constituting the side wall and the portion 7*e* for constituting the side wall and a front end of the projection portion 25 reaches a position in correspondence with an outer face of the portion 7*c* for constituting the side wall. In this way, at the side wall formed by the portions 7*d* and 7*e* for constituting the side wall, a plane is formed from the edge portion 27 of the portion 7*e* for constituting the side wall over to the front end of the projection portion 25, that is, from an outer face of the portion 7*b* for constituting the side wall over to an outer face of the portion 7*c* for constituting the side wall.

An explanation will be given here of an example of a constitution of a housing for forming a fuse box by mounting the female terminal 1 according to the embodiment. Further, although an explanation will be given here of a housing of a fuse boxy for mounting a single fuse, the fuse box can be constructed by a constitution of mounting a plurality of fuses. In this case, there is constructed a constitution similar to that of connecting a plurality of housings described here.

As shown by FIG. 4 and FIG. 5, a housing 29 of a fuse box is formed in a shape of a box of a rectangular parallelepiped and is formed with a fuse inserting port 31 for mounting a fuse at one end portion in a rectangular shape. As shown by FIG. 6, other end portion of the housing 29 in the rectangular shape is formed with two female terminal inserting ports 35 for inserting the female terminals 1 to two of cavities 33 constituting spaces for respectively containing the two female terminals 1 when the fuse box is integrated. As shown by FIG. 5, the fuse inserting port 31 is formed by a shape in correspondence with a shape of the fuse to be mounted and formed by an opening portion 31*a* in a rectangular shape and opening portions 31*b* in a slit-like shape having a width narrower than that of the opening portion 31*a* and respectively extended from centers of edge portions on sides of two short sides of the opening portion 31*a* to edge portions on sides of two short sides in correspondence with faces of the rectangular shape formed with the fuse inserting ports 31 of the housing 29.

As shown by FIG. 6, the female terminal inserting ports 35 are openings in a square shape capable of inserting the female terminal 1 and are formed by interposing an opening 37 in a rectangular shape formed at a central portion of a face in a rectangular shape formed with the female terminal inserting ports 35 of the housing 29. As shown by FIG. 7, the female terminal inserting ports 35 are respectively continuous to the cavities 33 which are spaces in a shape of a quadrangular cylinder capable of inserting the female terminals 1 formed at inside of the housing 29. Three faces of each of the two cavities 33 are partitioned by three side walls of the housing 29. That is, as shown by FIG. 6, each of the two cavities 33 is partitioned by a face in the rectangular shape formed with the fuse inserting port 31, either one of side walls 29*a* opposed to each other for forming short sides of faces in a rectangular shape formed with the female terminal inserting ports 35 and side walls 29*b* opposed to each other forming long sides.

As shown by FIG. 5 through FIG. 7, lances 39 are respectively provided at portions in correspondence with faces on sides in the housing 29 at which the two cavities 33 are contiguous to each other. One end portion of the lance 39 is fixed at a side of the housing 29 formed with the female terminal inserting port 35 and extended from the side of the female terminal inserting port 35 to the side of the fuse inserting port 31 of the housing 29. Other end portion of the lance 39 constituting a free end is provided with a locking portion 39*a* projected to an inner side of the cavity 33.

As shown by FIG. 7 and FIG. 8, walls 41 respectively projected in directions to the lances 39 are provided at portions from sides of the lances 39 of the side walls 29*b* of the housing 29 opposed to each other to between the locking portions 39*a* of the lances 39 and the fuse inserting port 31. Therefore, in the faces partitioning the cavities 33, portions of the faces of the two cavities 33 opposed to each other formed with the lances 33, are formed by the lances 33, the walls 41 projected from inner faces of the side walls 29*b* of the housing 29 opposed to each other, that is, the walls 41 projected in two side directions of the lances 33. Further, portions of the faces of the two cavities 33 opposed to each other which are not formed with the lances 33 are formed only by the walls 41 projected to the inner faces of the side walls 29*b* of the housing 29 opposed to each other. Therefore, the portions of the faces of the two cavities 33 opposed to each other which are not formed with the lances 33, that is, the portions from the locking portions 39*a* of the lances 39 to between the locking portions 39*a* and the fuse inserting port 31 are brought into a state of forming clearances in a slit-like shape extended in the direction of extending the cavities 33 interposed by the walls 41 projected from the inner faces of the side walls 29*b* of the housing 29 opposed to each other.

An explanation will be given of a characteristic portion of the invention of the female terminal 1 and the fuse box having the female terminal 1 according to the constitution. As shown by FIG. 9, the fuse box of the embodiment is mounted with the female terminal 1 in which an end portion of an electric wire 43 is attached to the electric wire attaching portion 9 is inserted into the cavity 33 of the housing 29 from the side of the protecting portion 11 of the female terminal 1 via the female terminal inserting port 35. When the female terminal 1 is mounted to the cavity 33 of the housing 29, as shown by FIG. 10 and FIG. 11, the female terminal 1 is inserted thereinto in a state in which the outer face of the connecting portion 13 and the inner face of the side wall 29*a* of the housing 29 partitioning the cavity 33 face each other until being brought into contact with the inner face of a wall portion 45 forming the opening portion 31*b* in the slit-like shape of the fuse inserting port 31 of the housing 29. Thereby, the locking portion 39*a* of the lance 39 is engaged with an edge of the side wall formed by overlapping the portions 7*d* and 9*e* for constituting the side wall of the tubular portion 7 of the female terminal 1 on the side of the electric wire attaching portion 9 and the female terminal 1 is locked in the cavity 33 of the housing 29 to fix.

When the female terminal 1 is mounted to the cavity 33 of the housing 29, as shown by FIG. 11 and FIG. 12, faces of the walls 41 projected at inner faces of the side walls 29*b* of the housing 29 opposed to each other on the side of the cavity 33 are respectively brought into a state of facing an outer face of the edge portion 27 of the portion 7*e* for constituting the side wall extended in a direction along a direction of extending the female terminal 1 and an outer face of the projection portion 25. Therefore, by bringing the respective faces of the walls 41 projected to the inner faces of the side walls 29*b* of the housing 29 opposed to each other on the side of the cavity 33 and the outer faces of the side edge 27 of the portion 7*e* for constituting the side wall and the outer face of the projection portion 25 into contact with each other, movement of the female terminal 1 for rotating around a rotating axis in a direction along the direction of inserting the female terminal 1 is restricted. That is, rattling of the female terminal 1 is difficult to be brought about by presence of the edge portion 27 of the portion 7*e* for constituting the side wall bulged in the side direction of the female terminal 1 at one corner portion side of the side wall facing the face of the cavity 33 of the tubular portion 7 formed with a clearance in a slit-like shape along the direction of inserting the female terminal 1 of the side wall, further, the projection portion 25 bulged in the side direction of the female terminal 1 on other corner portion side.

An explanation will be given here of an outline constitution of the fuse mounted to the fuse box formed by mounting the female terminal 1 of the embodiment to the housing 29. The fuse box formed by mounting the female terminal 1 shown in the embodiment to the housing 29 can be mounted with a minifuse, not illustrated, and a downsized minifuse downsized by reducing a height of a minifuse as shown by FIG. 9 and can be used for the minifuse and the downsized minifuse. The minifuse is a fuse having a well-known constitution in which two pieces of male tabs in a strip-like shape are bulged from one slender face of a main body having an outer shape substantially in a shape of a flat rectangular parallelepiped.

Meanwhile, according to the downsized minifuse 47, male tabs 47*b* in a strip-like shape integral with a main body 47*a* are formed at two side portions of the main body 47*a* having an outer shape substantially in a flat T-like shape and a total thereof is formed by an outer shape substantially in a shape of a flat rectangular parallelepiped having a size similar to that of a main body of the minifuse. In this way, according to the downsized minifuse 47, two pieces of the male tabs are hardly bulged from the main body as in the minifuse and a total thereof including the male tabs 47*b* are formed by an outer shape substantially in the shape of a flat rectangular parallelepiped having a size similar to that of the main body of the minifuse. Therefore, the height of the downsized minifuse 47 is made to be lower than that of the minifuse and is further downsized than the minifuse.

When the downsized minifuse 47 is mounted to the fuse box, a portion of the main body 47*a* disposed between the male tabs 47*b* is inserted into the opening portion 31*a* in the rectangular shape of the fuse inserting port 31 of the housing 29 and two pieces of the male tabs 47*b* are respectively inserted into the opening portions 31*b* in the slit-like shape of the fuse inserting port 31. Thereby, the male tab 47*b* of the downsized minifuse 47 is inserted between the pair of resilient strip portions 33 from the opening 21 formed at the protecting portion 11 of the female terminal 1 disposed at a vicinity of the inner face of the wall 45 formed with the opening portion 31*b* in the slit-like shape of the fuse inserting port 31 of the housing 29. At this occasion, the portion of the main body 47*a* of the downsized minifuse 47 disposed between the male tabs 47*b* is inserted into the clearance in the slit-like shape extended in the direction of extending the cavity 33 sandwiched by the walls 41 projected at the inner faces of the side walls 29*b* of the housing 29 opposed to each other.

In other words, in the housing of the fuse box for mounting the downsized minifuse 47, in order to prevent the portion of the main body 47*a* of the downsized minifuse 47 disposed between the male tabs 47*b* from interfering with the wall partitioning the cavity 33, in the faces for partitioning the cavity 33, at a portion on the side of the fuse inserting port 31 of the locking portion 39*a* of the lance 39 of the face opposed to the contiguous cavity 33, a clearance for inserting the portion of the main body 47*a* of the downsized minifuse 47 disposed between the male tabs 47*b* is necessary and only the walls 41 projected from the inner faces of the side walls 29*b* of the housing 29 opposed to each other can be formed.

Figure 13:
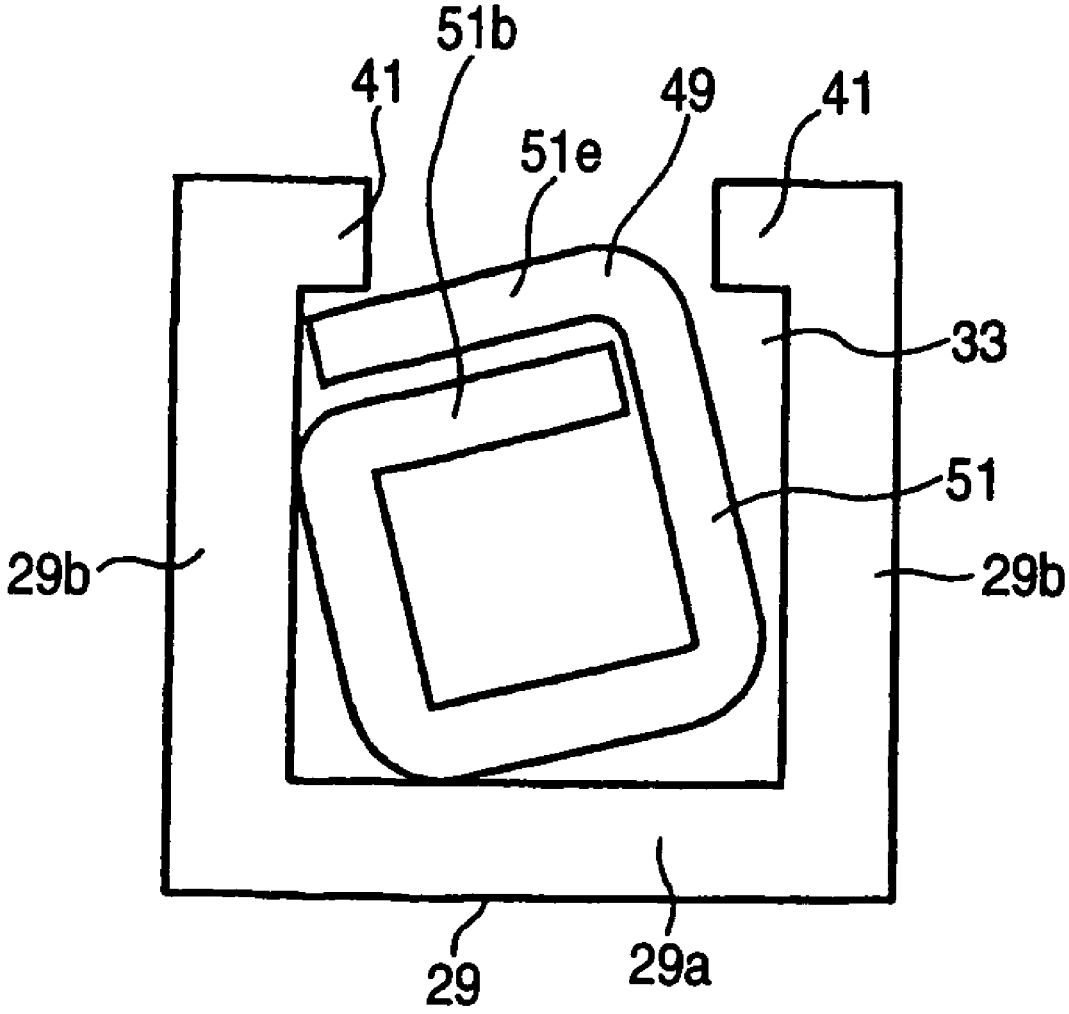
FIG. 13 (PRIOR ART)
FIG. 13 is a schematic view for explaining reason of bringing about rattling in a female terminal of a prior art.

When a female terminal 49 of a prior art is mounted to the housing 29, as shown by FIG. 13, since corner portions of a tubular portion 51 are formed by curved faces and therefore, depending on a relationship between a diameter of the curved face and a width between the inner faces of the walls 41 projected from the inner faces of the side walls 29*b* of the housing 29 opposed to each other, at the face of the cavity 33 formed with the clearance in the slit-like shape of the housing 29, the inner faces of the walls 41 projected from the inner faces of the side walls 29*b* of the housing 29 opposed to each other, that is, the face of the wall 41 on the side of the cavity 33 is not brought into contact with an outer face of a side wall formed by portions 51*d* and 51*e* for constituting the side wall of the tubular portion 51 of the female terminal 49, that is, an outer face of the portion 51*e* for constituting the side wall. Therefore, the female terminal 49 is moved to rotate around the rotating axis in the direction along the direction of inserting the female terminal 49 into the cavity 33 and therefore, rattling of the female terminal 49 is brought about.

The problem of bringing about rattling of the female terminal not only limited to the fuse box mounted with the downsized minifuse but is brought about also in housings of various electric connectors in which only a wall projected from an inner face of a side wall can be formed at a face of partitioning a cavity and a clearance in a slit-like shape is formed. In addition thereto, the problem is brought about also in the case in which a side wall of a tubular portion of a female terminal faces a portion of the face of the cavity formed with a lance by a size and a shape of the lance, and a size of a clearance between a side edge of the lance and walls projected from inner faces of the side walls of the housing opposed to each other. Therefore, the problem may be brought about also in electric connectors having various constitutions having a housing for locking a female terminal in a cavity by a lance.

In contrast thereto, according to the female terminal 1 of the embodiment, the edge portion 27 of the portion 7*e* for constituting the side wall is disposed at one corner portion side of the side wall facing the face of the cavity 33 formed with the clearance in the slit-like shape of the tubular portion 7 along the direction of inserting the female terminal 1 of the side wall and the projection portion 25 is provided at other corner portion side, thereby, movement of the female terminal 1 in the cavity 33 is restricted and the female terminal is difficult to rattle in the cavity 33. That is, regardless of the structure of the cavity of the housing, the female terminal can be made to be difficult to rattle in the cavity.

(Second Embodiment)

Figure 14:
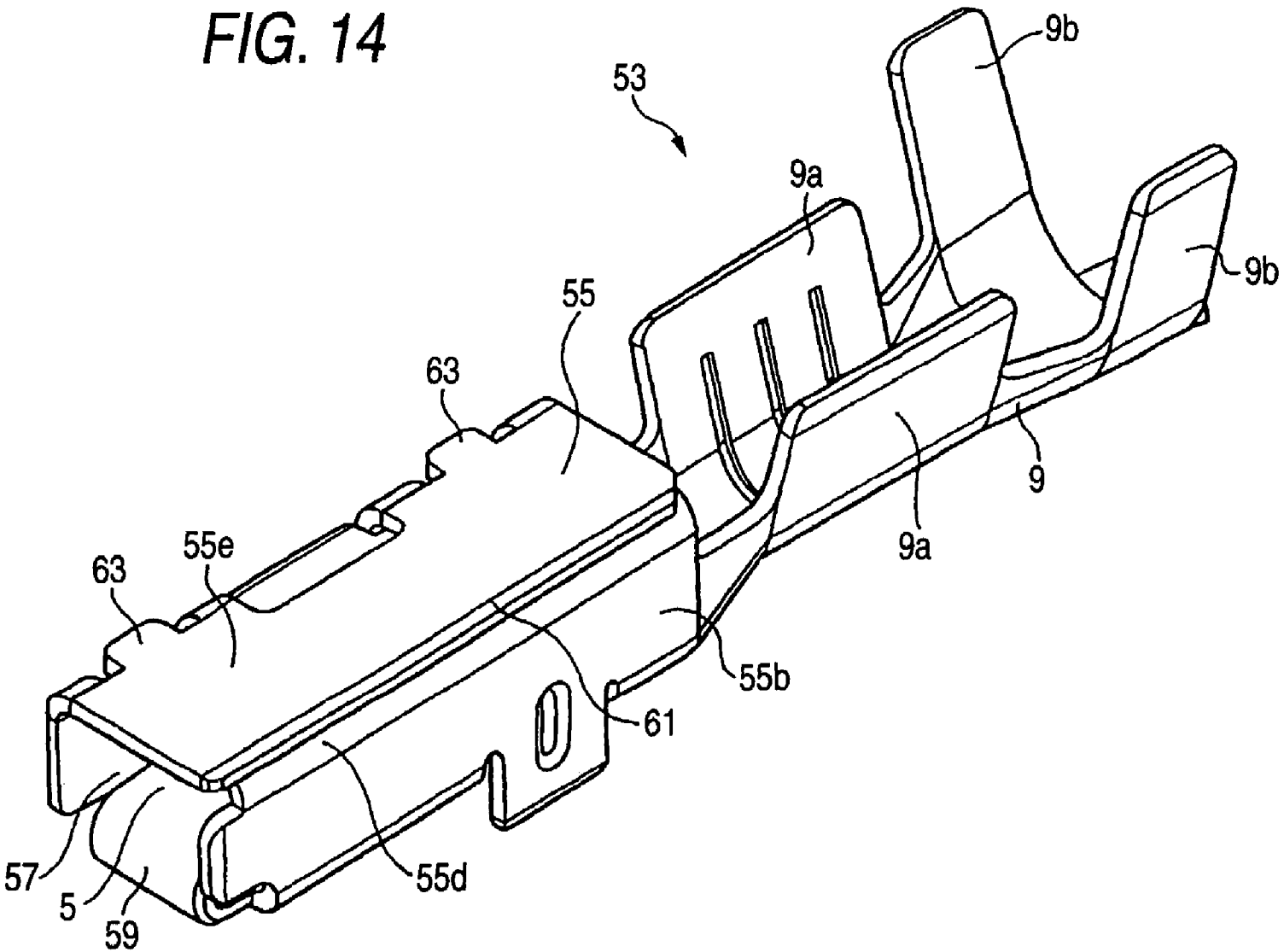
FIG. 14 is a perspective view showing an outline constitution of a second embodiment of a female terminal constituted by applying the invention.
Figure 15:
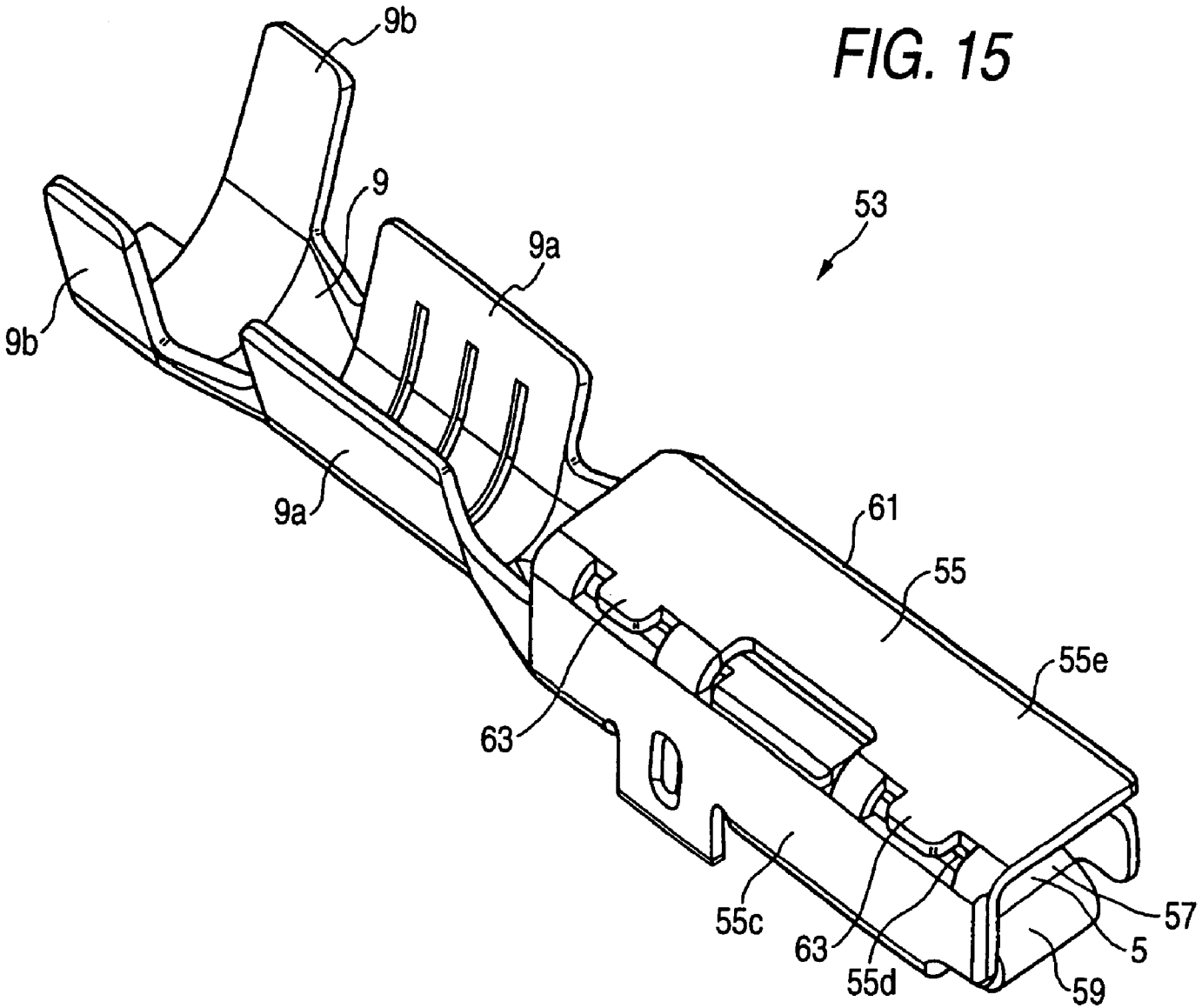
FIG. 15 is a perspective view showing the outline constitution of the second embodiment of the female terminal constituted by applying the invention.
Figure 16:
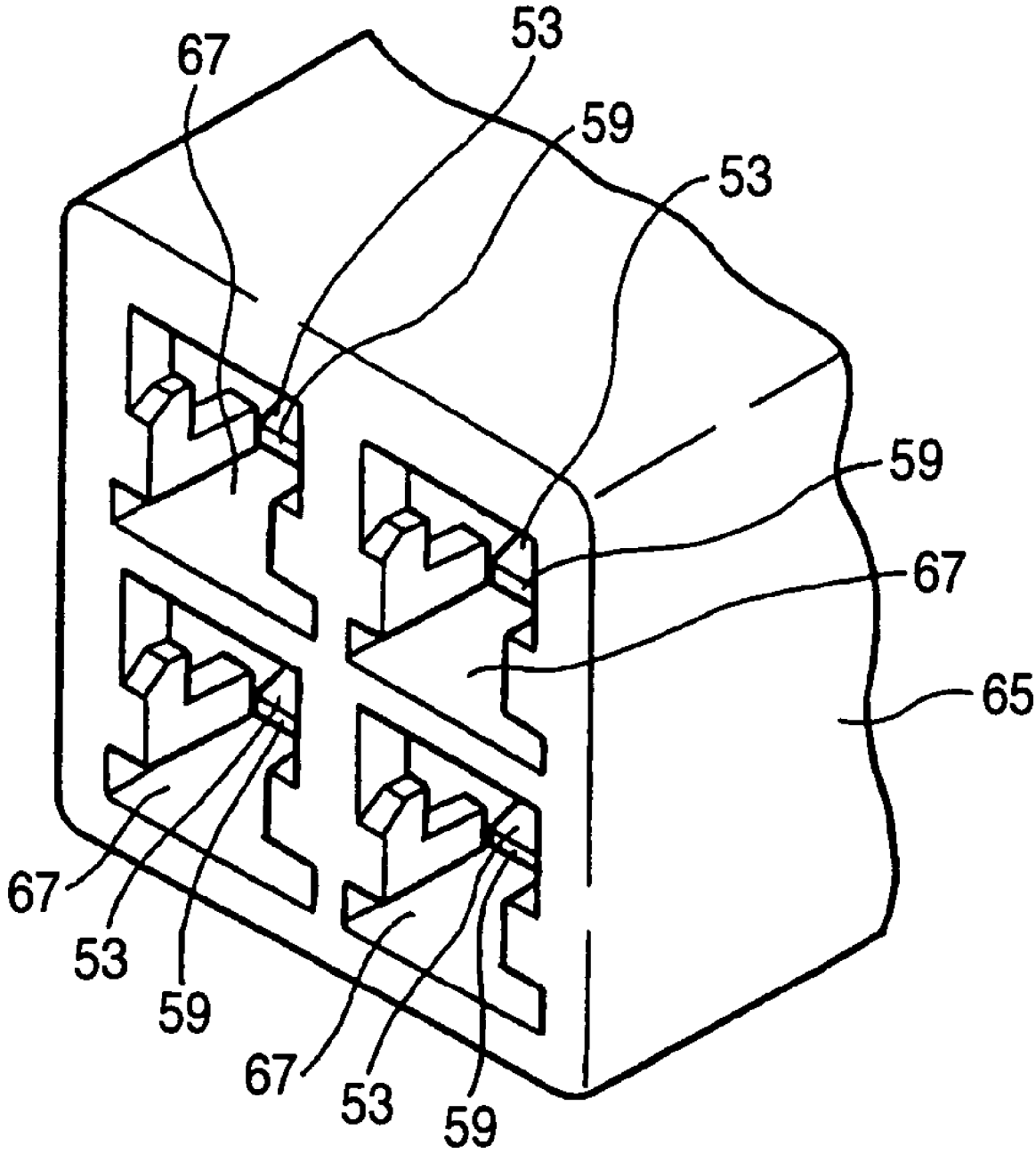
FIG. 16 is a perspective view showing a female type electric connector formed by mounting the female terminal constituted by applying the invention to a housing.

An explanation will be given of a second embodiment of female terminal constituted by applying the invention in reference to FIG. 14 through FIG. 16 as follows. FIG. 14 and FIG. 15 are perspective views showing an outline constitution of the female terminal constituted by applying the invention. FIG. 16 is a perspective view of a female type electric connector constituted by applying the invention. Further, according to the embodiment, constitution and operation the same as those of the first embodiment are attached with the same notations to thereby omit explanation thereof and an explanation will be given of a constitution and a characterizing portion which differ from those of the first embodiment.

A point of the female terminal according to the embodiment which differs from the first embodiment resides in the shape of the female terminal. That is, a female terminal 53 of the embodiment constitutes a female type electric connector connected with a male type electric connector having a male terminal and as shown by FIG. 14 and FIG. 15, a tubular portion 55 continuous to the electric wire attaching portion 9 is extended up to a front end portion of the female terminal 53. At inside of the tubular portion 55, there is incorporated one sheet of a resilient strip portion 59 in a strip-like shape folded back to an inner side of the tubular portion 55 at a portion of an inserting port 57 of a male terminal provided at a front end portion of the female terminal 53. The male terminal is inserted between an outer face of the resilient strip portion 59 which is folded back and an inner face opposed to the outer face of the resilient strip portion 59 of the tubular portion 55 and a contact is constituted by a portion at which the resilient strip portion 59 and the male terminal is brought into contact with each other. In this way, according to the female terminal 53 of the embodiment, the connecting portion 5 comprising the resilient strip portion 59 and the like for connecting to the male terminal is incorporated at inside of the tubular portion 55.

The female terminal 53 is also formed by bending one sheet of a formed conductive metal plate, the tubular portion 55 is also formed by portions 55*a* through 55*e* for constituting side walls in correspondence with the portions 7*a* through 7*e* for constituting the side walls of the first embodiment, and corner portions constituted by folding to bend the portions 7*a* through 7*e* for constituting the respective side walls are constituted by curved faces. The side wall having an inner face opposed to an outer face of the resilient strip portion 59 of the tubular portion 55 is formed by overlapping the portion 55*d* for constituting the side wall and the portion 55*e* for constituting the side wall in correspondence with the portions 7*d* and 7*e* for constituting the side walls of the first embodiment. An edge portion 61 of the portion 55*e* for constituting the side wall extended in a direction along a direction of extending the female terminal 53 is bulged in the side direction of the female terminal 1 in the state of covering the curved face of the corner portion at the corner portion side of the portion 55*b* for constituting the side wall and the portion 55*d* for constituting the side wall and reaches a position in correspondence with an outer face of the portion 55*b* for constituting the side wall.

Projection portions 63 in a tongue-like shape projected in the side direction of the tubular portion 55 are respectively provided on the side of a corner portion opposed to the side of the corner portion of the portion 55*b* for constituting the side wall and the portion 55*d* for constituting the side wall, that is, on the side of the corner portion of the portion 55*c* for constituting the side wall and the portion 55*e* for constituting the side wall at positions proximate to the both end portions of the tubular portion 55. Front ends of the two projection portions 63 are bulged in the side direction of the female terminal 53 in a state of overlapping the curved face of the corner portion of the portion 55*c* for constituting the side wall and the portion 55*e* for constituting the side wall and reaches positions in correspondence with the outer face of the portion 55*c* for constituting the side wall. The projection portion 63 is formed in a plane the same as that of the portion 55*e* for constituting the side wall formed with the projection portion 63 when the tubular portion 55 is formed by folding to bend. In this way, at the side wall formed by the portions 55*d* and 55*e* for constituting the side wall, there is brought about a state of forming a plane from the edge portion 55 of the portion 55*e* for constituting the side wall over to the front end of the projection portion 63.

By mounting the female terminal 53 into a cavity, not illustrated, of a housing 65, a female type electric connector having a male terminal inserting port 67 as exemplified in FIG. 13 is formed. According to the housing 65 of the female type electric connector, as explained also in the first embodiment, rattling is brought about in the female terminal of the prior art by a size or a shape of a lance, not illustrated, a size of an interval between a side edge of the lance and walls projected from inner faces of the side walls of the housing opposed to each other and the like.

In contrast thereto, by using the female terminal 53 of the embodiment, similar to the first embodiment, regardless of the structure of the cavity of the housing, the female terminal can be made to be difficult to rattle in the cavity.

Further, the invention is not limited to the female terminals having constitutions of the first and the second embodiments but is applicable to various female terminals formed by bending one sheet of a formed conductive metal plate. Further, shapes of the edge portion of the side wall of the tubular portion and the projection portion, a number of the projection portions and the like can pertinently be set. In addition thereto, the effect of the invention is achieved when at least the portion of the edge portion of the side wall of the tubular portion is brought into a state of overlapping the corner portion.

According to the invention, regardless of the structure of the cavity of the housing, the female terminal can be made to be difficult to rattle in the cavity.

What is claimed is:

1. A female terminal comprising:

a connecting portion having a resilient strip portion configured to be connected to a mating terminal;

a tubular portion continuous to the connecting portion;

wherein the connecting portion and the tubular portion are integrally formed by bending a metal plate;

wherein the tubular portion includes:

a face on which an edge portion is disposed at a first corner portion of the tubular portion, and a projection portion formed at a second corner portion located on an opposite side of the face from the first corner portion, the projection portion projecting from the second corner portion in a direction away from the edge portion.

2. A female terminal according to claim 1, wherein at least a part of the edge portion and the projection portion are respectively positioned so as to overlap with the corresponding first and second corner portions.

3. An electric connector including the female terminal according to claim 1.

* * * * *